United States Patent [19]

Berkey

[11] 4,082,287

[45] Apr. 4, 1978

[54] TRAINING APPARATUS FOR IMPROVING A GOLFER'S PUTTING TECHNIQUE

[75] Inventor: George V. Berkey, Palm Desert, Calif.

[73] Assignee: Mr. Putt, Incorporated, Palm Desert, Calif.

[21] Appl. No.: 725,688

[22] Filed: Sep. 23, 1976

[51] Int. Cl.[2] ..... A63B 69/36

[52] U.S. Cl. ..... 273/186 C; 273/192; 273/183 E; 206/315 B

[58] Field of Search ..... 273/192, 183 E, 187 A, 273/186 C, 183 D, 191 R, 191 A, 186 R; 35/29 A; 206/315 B

[56] References Cited

U.S. PATENT DOCUMENTS

| | | | |
|---|---|---|---|
| 1,091,186 | 3/1914 | Brown | 273/183 E X |
| 2,754,125 | 7/1956 | Engler | 273/192 |
| 3,471,155 | 10/1969 | Donaldson | 273/192 X |
| 3,524,650 | 8/1970 | Brandell | 273/183 E |
| 3,656,752 | 4/1972 | Moriarty | 273/192 X |
| 3,857,570 | 12/1974 | Gutierrez et al. | 273/186 C |
| 3,880,430 | 4/1975 | McCabe | 273/183 D |

*Primary Examiner*—George J. Marlo
*Attorney, Agent, or Firm*—Fulwider, Patton, Rieber, Lee & Utecht

[57] ABSTRACT

A training apparatus for use by golfers in improving their putting, having a base for placement on a putting surface adjacent a golf ball, and a cantilever projecting outwardly from the base. The cantilever has, at its outer edge, horizontal upper and lower guide strips of different colors in spaced vertical relation, for placement directly over the golf ball and for providing a reference of the direction in which the golf ball is desired to be putted. The apparatus is preferably formed of transparent plastic material and the cantilever is also provided with a series of spaced reference lines normal to said guide strips.

15 Claims, 5 Drawing Figures

11
23
23
19
17
25
15
13

39
19
47
21
45
35

11
29
23
17
49
19
3
31
23
27
5
5
25
33
35
47
45
37
15
3
13

39
19
17
37
43
41
21
49
45
15

39
43
17
19
37
41
49
45
15
25
35
31
29
27

TRAINING APPARATUS FOR IMPROVING A GOLFER'S PUTTING TECHNIQUE

BACKGROUND OF THE INVENTION

This invention relates to apparatus for use by golfers in improving their putting techniques.

The putting stroke is probably the most important, but the least mastered of all the strokes in the typical golfer's repertoire. If any golfer is to advance beyond the level of mediocrity, it is essential that he devote substantial time to the practice of his putting. By the continued repetition of the putting stroke, the golfer can develop consistency and thereby acquire much needed self-confidence. However, such putting practice is worthwhile only if the golfer practices a proper putting technique.

In the past, there have been a number of training devices used by golfers seeking to acquire a proper putting technique. Such devices of the prior art generally suffer from a number of deficiencies. Such prior art devices have been designed to help the golfer improve only one or a limited number of the numerous facets of the proper putting technique. Concentration on only a few such facets, while neglecting the balance, can be as destructive as it is beneficial. Learning to overcome one bad habit may come only at the expense of unknowingly acquiring another.

Some devices of the prior art, while enabling the golfer to refine one aspect of his putting stroke, actually induce him to develop a poor technique with respect to other aspects. For example, some of such prior devices are intended to help the golfer maintain the putter head in precise line with the direction in which the ball is sought to be putted, but require the golfer to maintain the toe of the putter head in sliding contact with a guide plate. Such a device has the destructive effect of creating a dependence on the device, to the extent that the golfer cannot reproduce the stroke in a non-practice situation. Other devices of the prior art have included reference lines for helping the golfer to continuously maintain the face of the putter head precisely perpendicular to the direction in which the ball is sought to be putted, but can be used only by raising the putter head to an improper height above the putting surface so as to avoid scraping the sole of the putter on portions of the device.

It will be appreciated from the foregoing that there is a definite need for a device for use by golfers in improving more than just one or a few facets of their putting techniques and one which does not help the golfer improve one facet of his stroke at the expense of fostering bad habits in others. The present invention fulfills this need.

SUMMARY OF THE INVENTION

The present invention resides in a unique and effective training apparatus for improving a golfer's putting technique, which contains features designed to help the golfer develop numerous facets of the proper putting technique.

More particularly, a training apparatus constructed in accordance with the present invention, includes a base for placement on a putting surface, adjacent a golf ball, and a cantilever extending outwardly from the base. Attached to the cantilever, or formed as a part thereof, are guide means for providing a reference of the direction in which the ball is intended to be putted. The base member is oriented on the putting surface, adjacent the golf ball, such that the guide means is positioned directly over the golf ball and so that the longitudinal axis of the guide means is in line with the direction in which the ball is intended to be putted. The golfer is thereby helped to maintain the putter head continuously in line with such direction. In addition to providing a direction reference, the guide means enables the golfer to position his eyes in perfect vertical alignment with the ball, thereby minimizing any distortion of the golfer's view of the ball's intended path.

The cantilever is preferably made of transparent plastic and bears a plurality of horizontally spaced reference lines, perpendicular to the longitudinal axis of the guide means, whereby the golfer can more easily maintain the face of the putter perpendicular to the desired direction of travel, throughout the putting stroke. The cantilever and guide means are disposed high enough above the putting surface to readily accommodate passage of the golf ball and putter head, but low enough to induce the golfer to learn the proper technique of maintaining the putter head close to the putting surface throughout the putting stroke.

It will be appreciated from the foregoing that the present invention represents a significant advance in the design of training apparatus for improving a golfer's putting technique. In particular, it provides a simple, but effective apparatus which is useful for improving numerous facets of the golfer's putting technique. Other aspects and advantages of the invention will become apparent from the following detailed description taken in conjunction with the accompanying drawings.

DESCRIPTION OF THE PREFERRED EMBODIMENT

Figures 1, 2, 3, 4, 5:
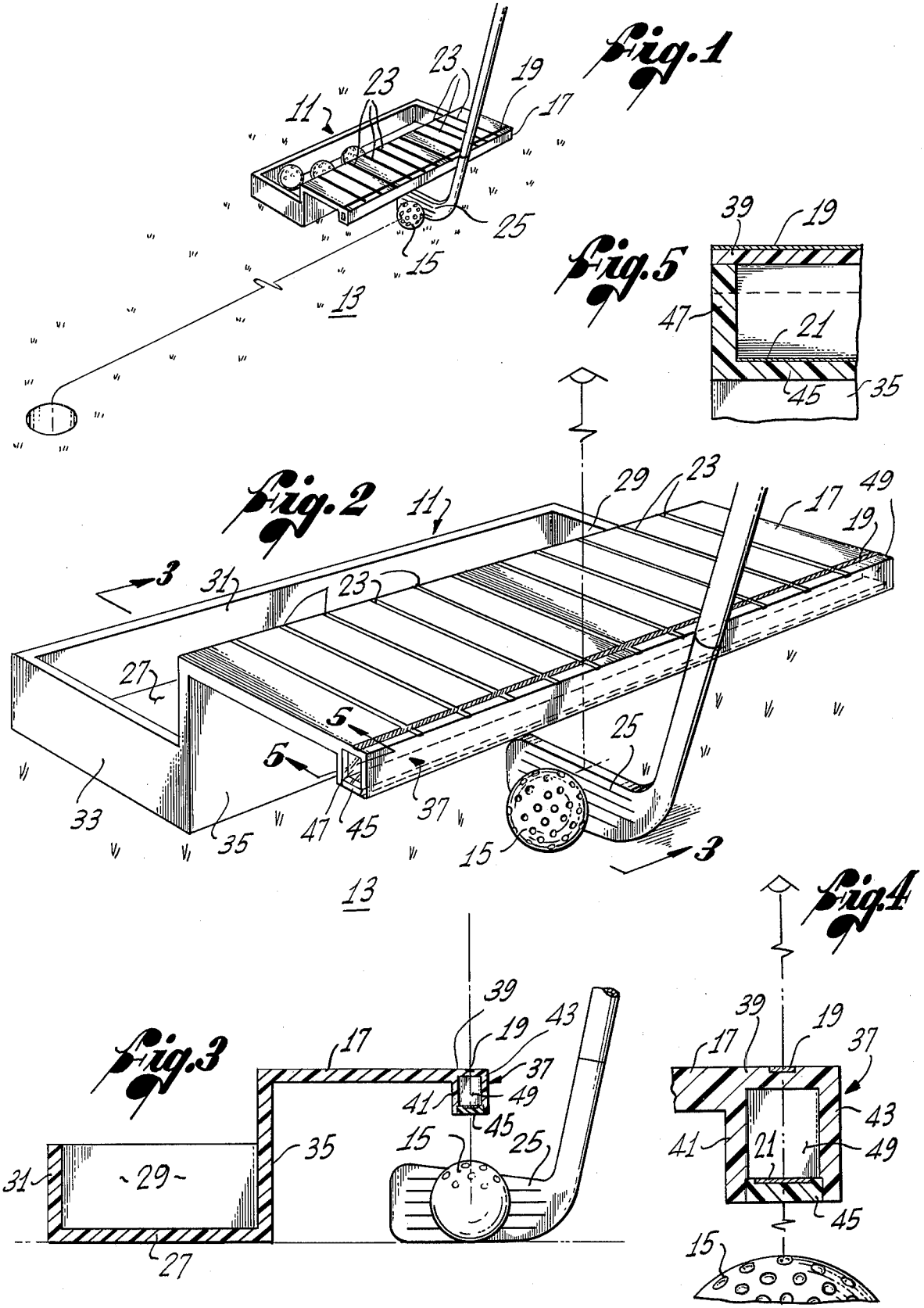
FIG. 1 is a perspective view of the training apparatus, putter head and golf ball as they are used on a putting surface.
FIG. 2 is a closeup perspective view of the training apparatus, putter head and golf ball.
FIG. 3 is a sectional end elevation view of the training apparatus, putter head and golf ball.
FIG. 4 is a detailed sectional view of the guide means and a portion of the cantilever.
FIG. 5 is a sectional view taken on the line 5—5 of FIG. 2.

As shown in the accompanying drawing, the present invention is embodied in training apparatus for improving numerous facets of a golfer's putting technique. Certain prior art devices were designed to help the golfer improve one or a few of such putting technique facets, but in doing so, the balance of the facets were completely neglected, and in some instances, golfers were induced to develop bad habits or otherwise improper techniques in such other facets. The training apparatus of the present invention can be used by the golfer to acquire an improved putting technique, without the disadvantages of the prior art just described.

Briefly, the training apparatus of the invention, depicted in FIGS. 1 and 2, includes a base 11, which can be placed on a putting surface 13 adjacent a golf ball 15, and a transparent cantilever 17 projecting out from the base 11 in the direction of the golf ball 15. Any suitable putting surface 13 can be used, such as a practice putting green at a golf course or a living room carpet.

Carried by the cantilever 17 are two guide strips 19 and 21, preferably of different colors, in spaced vertical relation, which provide a reference of the direction in which the ball 15 is sought to be putted. The guide strips 19 and 21 help the golfer maintain the putter in line with such direction throughout the putting stroke and, in addition, help him position and maintain his eyes directly over the ball 15. The cantilever 17 is provided with a series of horizontally spaced reference lines 23, which are perpendicular to the guide strips 19 and 21, thereby helping the golfer to continuously maintain the face of a putter head 25 square to the intended direction of travel. The reference lines 23 may be formed by molding grooves in the upper face or ribs on the lower face of the cantilever 17, or by otherwise suitably marking the cantilever so as not to obstruct the view of the putter head. Additionally, the cantilever 17 and guide strips 19 and 21 are low enough to cause the golfer to maintain the putter head 25 close to the putting surface 13 throughout the putting stroke.

Considering the construction in somewhat greater detail, the training apparatus' base 11 is preferably in the shape of an open-top rectangular box, having a bottom 27 and four walls 29, 31, 33 and 35. As constructed, the base 11 forms a receptacle for the convenient storage of any suitable objects, such as golf balls, as shown in FIG. 1. The base 11 is placed on the putting surface 13, adjacent the golf ball 15, where it assumes the slope of such putting surface 13.

The cantilever 17 is connected to, and projects outwardly from, wall 35 of the base 11. The cantilever 17 is preferably rectangular in shape, having a length approximately the same as that of the base 11 and a width large enough to permit passage of a putter head 25 beneath it without scraping any portion of the base 11.

Connected to the outside edge of the cantilever 17 or formed as a part thereof, is a channel 37, having a top wall 39 which is preferably an extension of cantilever 17, and side walls 41 and 43, projecting downwardly therefrom. Connected to the respective bottom edges of the channel's side walls 41 and 43 is a channel insert 45, which is supported thereby in spaced vertical relation to the channel's top wall 39. The channel 37 and the channel insert 45 extend substantially the entire length of the cantilever 17.

Attached to the respective ends of the insert 45 are upstanding end caps 47 and 49, for insuring that the space contained within the walls of the channel 37 and the channel insert 45, remains free of dust and dirt.

The cantilever 17, channel 37, channel insert 45 and the end caps 47 and 49 are all disposed high enough above the putting surface 13 to accommodate convenient passage of the golf ball 15 and the putter head 25 beneath them, yet low enough to insure that the golfer will maintain the putter head 25 close to the putting surface 13 throughout the putting stroke.

The cantilever 17, channel 37, channel insert 45 and the ends caps 47 and 49 are all constructed of any suitable transparent plastic, such as Plexiglass or Lucite, thereby enabling the golfer to observe the golf ball 15 and the putter head 25 when such are situated thereunder. As shown in FIGS. 3, 4 and 5, it is convenient and preferable to mold as one unit, the base 11, cantilever 17 and channel 37. The channel insert 45 and the end caps 47 and 49 are preferably molded as a separate unit and secured to the channel side walls 41 and 43 by any suitable means such as a snap-fit or cement.

Affixed to the upper side of the top wall 39 of the channel 37, preferably in a molded groove extending the length thereof, is the upper guide strip 19. Similarly, affixed to the upper side of the channel insert 45, preferably in a molded groove extending the length thereof, is the lower guide strip 21, parallel to, and directly below, the upper guide strip 19.

The width of the lower guide strip 21 is slightly greater than the width of the upper guide strip 19, and the two strips are preferably of different colors, or shades of one color, whereby the lower guide strip 21 can be readily observed on both sides of the upper guide strip 19, when viewed by the golfer from a position directly thereabove. Because of the vertical relation of the two guide strips 19 and 21, a parallax is created by any movement of the golfer's eyes, so that he is provided with the facility to maintain his eyes and head substantially motionless above the ball while putting. The colored guide strips 19 and 21 may be formed by ribbons of tape or by paint, hot stamping or other suitable means. It will also be appreciated that in lieu of the hollow box-like channel 37 and insert cover 45, the outer edge portion of the cantilever 17 may be thickened and the colored strips 19 and 21 applied directly to the upper and lower faces thereof.

The training apparatus is used by placing the base 11 on the putting surface 13 and positioning the golf ball 15 at any convenient point directly beneath the guide strips 19 and 21. Further, the base 11 is oriented so that the guide strips 19 and 21 are precisely in line with the direction in which the ball 15 is desired to be putted.

The training apparatus can be used by both right and left handed golfers. To use the apparatus, the golfer assumes a putting stance on the side of the cantilever 17 opposite the base 11. He can conveniently use the channel 37 or guide strips 19 and 21 as a reference for assuming the stance which feels most comfortable to him, whether it be open, square or closed. The golfer positions his eyes immediately above the ball, along the line that is normal to the portion of the putting surface 13 on which the ball 15 and base 11 rest. With his eyes thus positioned, the golfer is able to minimize any distortion of his view of the ball's intended path. The guide strips 19 and 21 are also used as a reference for maintaining the putter head 25 in line with the desired direction of the ball's travel, throughout the putter's backswing, stroke and follow-through.

The series of periodic horizontally spaced lines 23, all at right angles to the guide strips 19 and 21, provide the golfer with references by which he can more easily maintain the face of the putter head 25, throughout the putting stroke, perpendicular or "square" to the direction in which the ball 15 is sought to be putted. Additionally, the lines 23 are useful in helping the golfer determine the length of each backswing and thereby acquire greater consistency in the firmness with which he strokes each putt.

Although the training apparatus for improving a golfer's putting technique has been described with reference to one preferred embodiment, it will be understood by one skilled in the art that modifications can be made which will still embody the spirit of the invention herein described.

I claim:

1. For use on a putting surface with a putter and a golf ball, a training apparatus for improving putting, comprising:

a base for placement on the putting surface adjacent the golf ball;

a cantilever extending outwardly from said base over the putting surface, said cantilever being constructed of a transparent material; and elongated visual guide means carried by said cantilever adjacent the outer edge thereof, said guide means including an upper guide strip and a lower guide strip of contrasting colors or shades, said guide strips supported horizontally, one above the other, in spaced vertical relation;

said base, when in use, being oriented on the putting surface so that said upper and lowr guide strips are positioned directly over the golf ball and so that the longitudinal axes of said guide strips are aligned with the direction in which the golf ball is to be putted;

said cantilever and said visual guide means being sized so that the head of the putter passes readily thereunder to strike the golf ball, without bearing on any portion of the apparatus.

2. A training apparatus for improving putting, as defined in claim 1, wherein said cantilever includes a series of spaced horizontal lines, at right angles to said guide means, whereby the golfer is provided references to help him maintain the face of said putter head perpendicular to the direction in which said golf ball is sought to be putted.

3. A training apparatus for improving putting, as defined in claim 2, wherein said horizontal lines are spaced substantially periodically along the entire length of said cantilever.

4. A training apparatus for improving putting, as defined in claim 1, wherein the spacing of said cantilever and said visual guide means above the putting surface is only slightly greater than the height of the golf ball and the head of the putter when properly positioned thereunder.

5. Apparatus as defined in claim 1, wherein said upper guide strip is narrower than said lower guide strip, whereby a golfer can observe said lower guide strip on both sides of said upper guide strip when his eyes are positioned directly thereover.

6. For use on a putting surface with a putter and a golf ball, a training apparatus for improving putting, comprising:

a base for placement on the putting surface adjacent the golf ball;

a cantilever extending outwardly from said base over the putting surface, said cantilever being constructed of a transparent material; and elongated visual guide means carried by said cantilever adjacent the outer edge thereof;

said cantilever including a series of spaced reference lines, normal to the longitudinal axis of said visual guide means;

said base, when in use, being oriented on the putting surface so that said visual guide means is positioned directly over the golf ball and so that the longitudinal axis of said guide means is aligned with the direction in which the golf ball is to be putted;

said cantilever and said visual guide means being sized so that the head of the putter passes readily thereunder to strike the golf ball, without bearing on any portion of the apparatus.

7. A training apparatus for improving putting, as defined in claim 6, wherein said guide means includes an upper guide strip and a lower guide strip, said guide strips being supported substantially horizontally one above the other in spaced vertical relation, whereby a golfer can position his eyes directly over said guide strips.

8. A training apparatus for improving putting, as defined in claim 7, wherein said upper guide strip and said lower guide strip are of contrasting colors or shades, whereby the golfer can readily distinguish one guide strip from the other when his eyes are positioned thereover.

9. A training apparatus for improving putting, as defined in claim 8, wherein said upper guide strip is narrower than said lower guide strip, whereby the golfer can observe said lower guide strip on both sides of said upper guide strip when his eyes are positioned directly over said guide strips.

10. A training apparatus for improving putting, as defined in claim 8, wherein the spacing of said cantilever and said visual guide means above the putting surface is only slightly greater than the height of the golf ball and the head of the putter when properly positioned thereunder.

11. A training apparatus for improving putting, as defined in claim 6, wherein said base includes sidewalls defining a receptacle for storing items such as golf balls.

12. Apparatus as defined in claim 6, wherein said guide means comprises a hollow channel structure formed along the outer edge of said cantilever, the upper face thereof carrying a guide strip thereon of one color and the lower face thereof carrying a guide strip thereon of a contrasting color or shade and in vertical alignment therewith.

13. Apparatus as defined in claim 12, wherein said upper face guide strip is narrower than said lower face guide strip, whereby a golfer can observe said lower guide strip on both sides of said upper guide strip when his eyes are positioned directly thereover.

14. A training apparatus for improving putting, as defined in claim 6, wherein said reference lines are spaced substantially periodically along the entire length of said cantilever 15. For use on a putting surface with a putter and a golf ball, a training apparatus for improving putting, comprising;

a base for placement on the putting surface adjacent the golf ball;

a cantilever extending outwardly from said base over the putting surface, said cantilever being constructed of a transparent material; and elongated visual guide means carried by said cantilever adjacent the outer edge thereof, said guide means including an upper guide strip and a lower guide strip, said guide strips being of contrasting shades or colors and supported horizontally, one above the other, in spaced vertical relation, said upper guide strip being narrower than said lower guide strip, whereby a golfer can observe said lower guide strip on both sides of said upper guide strip when his eyes are positioned directly thereabove;

said cantilever including a series of reference lines spaced substantially periodically along the entire length thereof, said reference lines being normal to the longitudinal axes of said upper and lower guide strips;

said base, when in use, being oriented on the putting surface so that said upper and lower guide strips are positioned directly over the golf ball and so that the longitudinal axes of said guide strips are aligned with the direction in which the golf ball is to be putted;

said cantilever and said visual guide means being sized and, when in use, being spaced above the putting surface so that the head of the putter must be maintained in relatively close relation to the putting surface throughout a stroke of the golf ball and so that the head of the putter does not bear on any portion of the apparatus.

* * * * *